US005277364A

United States Patent [19]

Heffner et al.

[11] Patent Number: 5,277,364

[45] Date of Patent: Jan. 11, 1994

[54] DUAL CAPACITY THERMAL EXPANSION VALVE

[75] Inventors: Joseph H. Heffner, Chesterfield; David C. Dorste, Frontenac, both of Mo.

[73] Assignee: Sporlan Valve Company, St. Louis, Mo.

[21] Appl. No.: 992,706

[22] Filed: Dec. 18, 1992

[51] Int. Cl.[5] ..... F25B 41/04

[52] U.S. Cl. ..... 236/92 B; 62/212; 62/225

[58] Field of Search ..... 236/92; 62/222, 223, 62/224, 225, 210, 211, 212, 213, 204, 205, 206

[56] References Cited

U.S. PATENT DOCUMENTS

| | | | |
|---|---|---|---|
| 3,252,297 | 5/1966 | Leimbach et al. | 62/225 |
| 3,699,778 | 10/1972 | Orth | 236/92 B |
| 4,095,742 | 6/1978 | Schumacher | 62/225 |
| 5,177,972 | 1/1993 | Sillato et al. | 62/205 |

*Primary Examiner*—Harry B. Tanner
*Attorney, Agent, or Firm*—Cohn, Powell & Hind

[57] ABSTRACT

This expansion valve (10) can be used for a refrigeration system (1) having a compressor (2), an evaporator (3) and a condenser (4). The valve (10) comprises a body (12) including an inlet passage (26), an outlet passage (38), a piston passage (28) defining a piston port (30) and valve chamber (32), the piston passage (28) defining a piston chamber (46) communicating with valve chamber (32). A piston (40) is movably mounted in the piston passage (28) and selectively controls flow through the piston port (30), the piston (40) having an interior passage (60) communicating with the inlet passage (26) and having a pin port (62) communicating with the valve chamber (32), the piston (40) having a biasing spring (52) biasing the piston (40) into a closed position. A valve pin (70) is movably mounted in the valve chamber (32) and controls flow through the valve pin port (62), the valve pin (70) having a spring (74) biasing the pin (70) into the closed position. A temperature responsive diaphragm assembly (18) including a bulb (84) responsive to the outlet temperature of the evaporator (3) includes a diaphragm (82) connected to the valve pin (70) by pushrods (90) tending to move the pin (70) into an open position during normal load conditions and selectively connected to piston (40) tending to move the piston (40) into an open position during overload conditions to increase refrigerant flow through the valve (10).

7 Claims, 3 Drawing Sheets

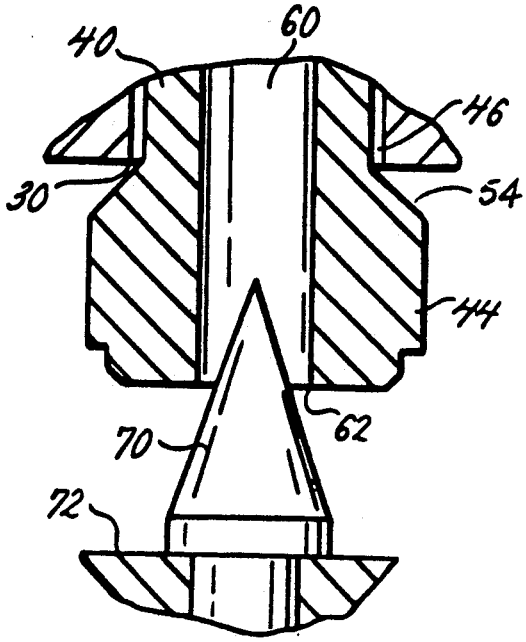
FIG. 4.
FIG. 5.
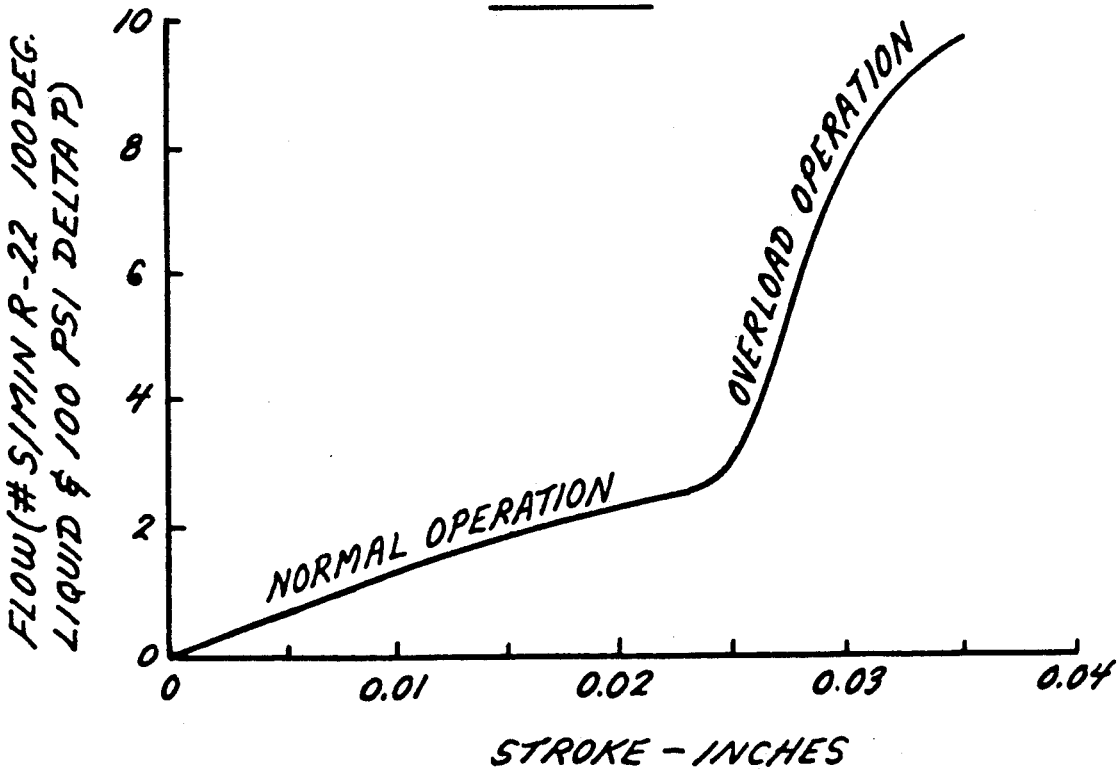

DUAL CAPACITY THERMAL EXPANSION VALVE

BACKGROUND OF THE INVENTION

This invention relates generally to expansion valves used in refrigeration systems and particularly to an expansion valve that provides for additional flow of refrigerant during pulldown conditions.

In any air conditioning system or refrigerated system, such as a display case, walk in room, freezer or chiller, the load on the evaporator is always greatest during pulldown conditions. The pulldown conditions are experienced, by way of example, when a display case has been defrosted or when the case has been loaded with a relatively warm food product. Once the initial pulldown period is over, and the discharge air from the evaporator is normal for the particular product being conditioned, the load on the evaporator is much smaller than during pulldown.

In practice, the pulldown load can be as much as 3to 3.5 times greater than normal load. In consequence, when sizing a thermostatic expansion valve in the past, for example for a display case, a compromise was found necessary so that the valve was sized to provide a pulldown period as short as possible, the result of which was an unreasonably oversized valve for normal holding loads. Oversized valves typically result in control problems and affect the efficiency of the refrigeration system.

Pulldown can also occur in an air conditioning system where the conditioned space is not controlled and allowed to approach outside ambient temperature. In the past, particularly in large systems, unloading features in the compressor were often used as necessary to accommodate capacity differences.

This improved expansion valve overcomes these and other problems in a manner not revealed by the known prior art.

SUMMARY OF THE INVENTION

This improved thermostatic expansion valve features two independent capacities, one for normal operating conditions and another, increased capacity, for handling pulldown conditions.

The improved valve provides, within the same valve body, one port for controlling the refrigerant flow during normal operating conditions and another port which is opened during pulldown or overload conditions to provide an additional flow path for the refrigerant. This arrangement eliminates the necessity for providing a single valve port of a compromise size to operate during both pulldown and normal operating conditions.

This expansion valve comprises a valve body including an inlet passage, an outlet passage, a piston passage including a piston chamber, and a valve chamber, the piston chamber communicating with the inlet passage and having a piston port communicating with the valve chamber and the valve chamber communicating with the outlet passage, a piston means movably mounted in the piston chamber and selectively controlling flow through the piston port, the piston means having an interior passage communicating with the inlet passage and having a pin port communicating with the valve chamber, the piston means having means biasing the piston means into a closed position, a valve pin means movably mounted in the valve chamber and controlling flow through the pin port, the valve pin means having means biasing the pin means into the closed position, temperature responsive means at one end of the valve body, means connecting the temperature responsive means to the valve pin means tending to move the pin means into an open position during normal load conditions, and means connecting the temperature responsive means to the piston means tending to move the piston means into the open position during overload conditions.

It is an aspect of this invention to provide that the valve body includes an abutment and the piston means includes a first end spaced from the abutment and a second end engageable with the valve port, and the piston biasing means includes spring means between the abutment and the first end of the piston means tending to urge the second end of the piston means into the closed position.

It is another aspect of this invention to provide that the valve body includes an axial passage having an upper end and a lower end, and the piston means includes an upper end received in sliding relation in the upper end of the axial passage and a lower end diametrically spaced from the lower end of the axial passage to define the piston chamber.

It is still another aspect of this invention to provide that an annular seal is provided between the upper end of the piston means and the upper end of the axial passage.

It is yet another aspect of this invention to provide that the temperature responsive means includes diaphragm means, and the means connecting the temperature responsive means to the pin means includes pushrod means extending between the diaphragm means and the pin means.

It is an aspect of this invention to provide that the temperature responsive means includes diaphragm means, and the piston means includes an upper end, and the means connecting the temperature responsive means to the piston means includes a buffer plate selectively engageable with the upper end of the piston means.

It is another aspect of this invention to provide that the valve body includes stop means, and the diaphragm means includes a buffer plate engageable with the stop means to limit movement of the piston means.

It is an aspect of this invention to provide a thermostatic expansion valve which is relatively simple and inexpensive to manufacture and operates with increased efficiency.

BRIEF DESCRIPTION OF THE DRAWINGS

FIG. 4 is an enlarged fragmentary sectional view showing the valve ports under the overload conditions of FIG. 3, and FIG. 5 is a diagrammatic representation of valve flow under normal and overload conditions.

DESCRIPTION OF THE PREFERRED EMBODIMENT

Figure 1:
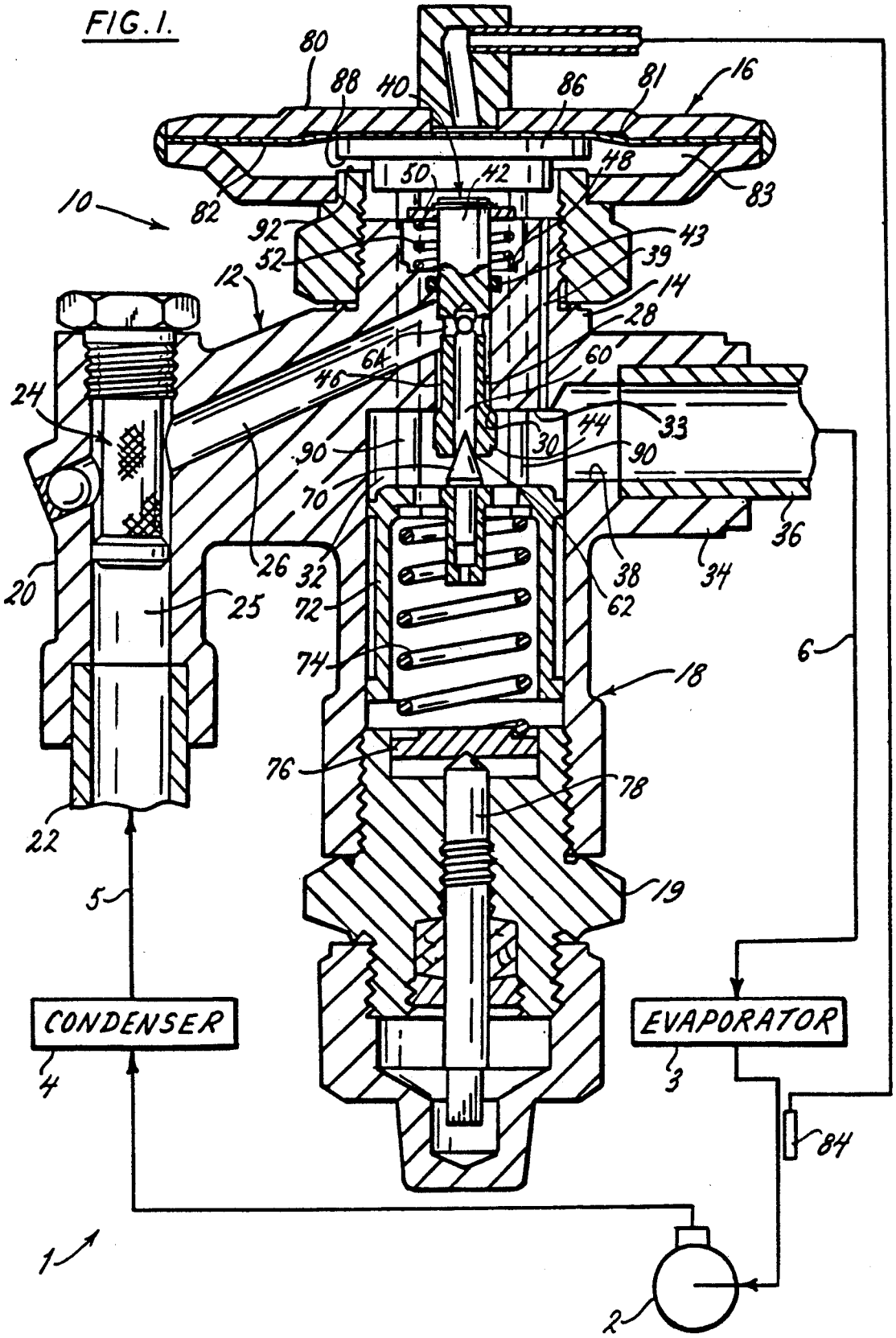
FIG. 1 is a longitudinal sectional view through the valve, showing the valve in the fully closed position.

Referring now by reference numerals to the drawings and first to FIG. 1 it will be understood that the expansion valve 10 in the embodiment shown is used in a refrigeration system 1 including a compressor 2, an evaporator 3, and a condenser 4 having inlet and outlet lines 5 and 6 connected to the valve 10.

The valve 10 includes a valve body 12 having an upper portion 14 with diaphragm assembly 16 threadedly connected to the upper end and a superheat spring assembly 18 at the lower end.

The valve body upper portion 14 includes an inlet fitting 20 having a sweated connection 22, a filter assembly 24 and an inlet passage including a vertical passage 25, an inclined passage 26 leading to an axial piston passage 28 having a piston port 30 at the lower end communicating with a valve chamber 32 having an upper wall 33 defining the piston port 30. The upper portion 14 also includes an outlet fitting 34 having a sweated connection 36 and an outlet passage 38 communicating with the valve chamber 32. The valve body upper portion 14 also includes an equalization passage 39 as will be discussed below.

A piston 40 is movably mounted in the piston passage 28 and said passage is sized to receive the piston upper end 42 in sliding relation. The piston passage 28 is grooved to receive a seal in the form of an O-ring 43 to prevent upward migration of refrigerant from the inclined passage 26. The piston lower end 44 is diametrically reduced in size to define a piston chamber 46 which communicates with the valve chamber 32 by way of the piston port 30. The valve body upper portion 14 is recessed to provide an abutment face 48, and the piston upper end includes a washer 50 held in place as by a snap ring to provide a retainer for a biasing spring 52 disposed between the abutment 48 and the washer 50 tending to urge the piston 40 upwardly. As best shown in FIG. 4, the piston lower end is enlarged to provide a conical surface 54 which, under normal load conditions, is urged into a closed position relative to the piston port 30 by the biasing spring 52. The piston 40 includes an internal axial passage 60 having a valve pin port 62 communicating with the valve chamber 32 and a transverse passage 64 communicating with the inclined inlet passage 26.

Flow of liquid refrigerant through the valve pin port 62 is controlled by a valve pin 70 which is mounted to a pin carrier 72 provided by a sliding retainer which receives a superheat spring 74. The spring 74 extends between the upper end of the pin carrier 72 and a sliding spring seat 76 which is adjusted by means of an adjustment screw 78 carried by a valve closure member 19 threadedly connected to the valve body 12. The superheat spring 74 tends to urge the valve pin 70 into the closed position and the valve pin tends to be urged into the open position in response to pressure on the diaphragm assembly 16.

The diaphragm assembly 16, which constitutes a thermal responsive means, includes a diaphragm casing 80, a diaphragm 82 defining upper and lower chambers 81 and 83 and a bulb assembly 84 which is disposed in heat responsive relation to a selected part of the refrigerator system, for example to the outlet of the evaporator 3. The diaphragm assembly 16 includes a buffer plate 86 which is connected to the valve pin carrier 72 by a pair of pushrods 90. The buffer plate 86 is also engageable with the upper end of the piston 40 and, when the diaphragm pressure is sufficiently high, can exert sufficient force on the piston 40 to open the piston port 30. The buffer plate 86 includes an annular abutment portion 88 and the diaphragm casing 82 includes an interior annular abutment 92, constituting a stop means, with which the buffer plate portion 88 is engageable to limit travel of the piston 40. Also, in the embodiment shown, the lower diaphragm chamber 83 and the valve chamber 32 are connected by the equalization passage 39.

It is thought that the structural features of this expansion valve have become fully apparent from the foregoing description of parts but for completeness of disclosure the operation of the valve under various load conditions will be briefly described.

Figure 2:
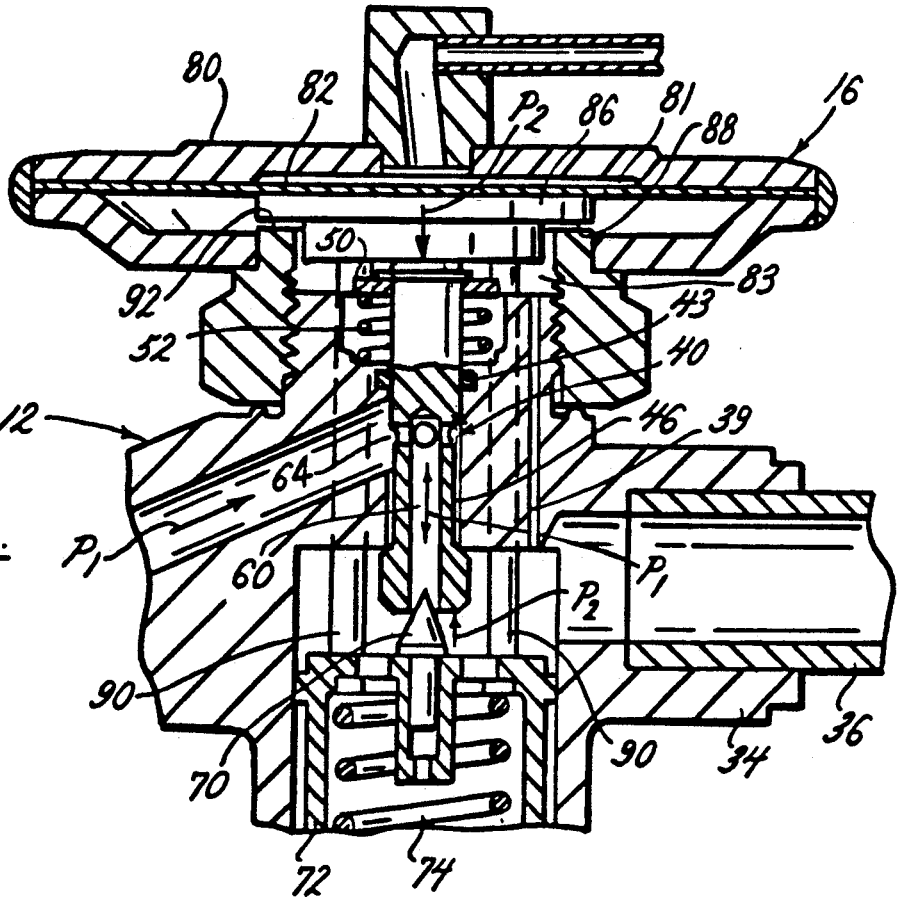
FIG. 2 is a fragmentary sectional view showing the valve under normal flow conditions.

Under normal flow conditions, shown in FIG. 2, the bulb temperature responds to the temperature of the evaporator outlet and the pressure on the diaphragm 80 moves the diaphragm and, by virtue of the buffer plate 86, the pushrods 90 and the pin carrier 72, this diaphragm movement moves the pin 70 relative to the valve port 62 at the lower end of the piston 40. In this normal flow condition there is insufficient pressure on the piston 40 to overcome the upward force exerted by the piston spring 52 which therefore urges the piston into the closed position shown in FIG. 2. In effect, the piston acts as though it were part of the valve body 12 and refrigerant flow depends only on the stroke of the valve pin. As illustrated graphically in FIG. 5 flow during the first 0.025 inches of stroke follows a relatively even, low curve.

Figure 3:
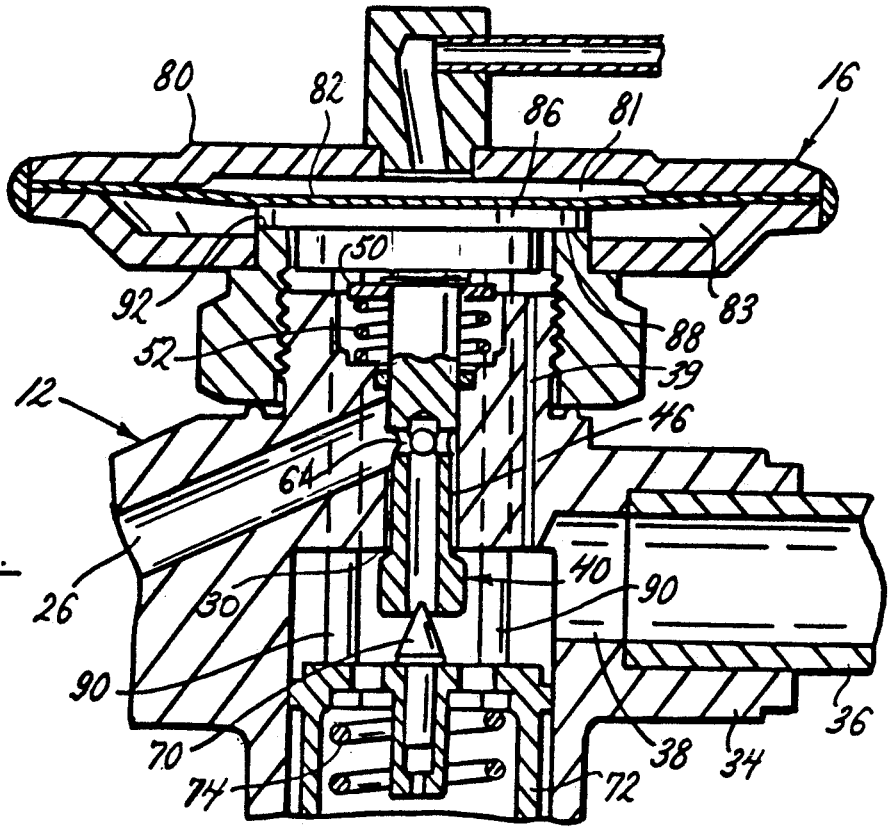
FIG. 3 is a fragmentary sectional view showing the valve under overload conditions.

FIGS. 3 and 4 illustrate that under high temperature conditions, such as occur during pulldown, a radical change occurs. Under pulldown overload conditions the pressure on the diaphragm 80 is sufficient to overcome the upward force of the spring 52 with the result that the piston 40 moves away from the piston port 30 so that the piston chamber 46 communicates directly with the valve chamber 32 and offers a secondary flow path and an additional annular area provided by the piston port 30 to that provided by the valve port 62. The flow during this operation increases dramatically as shown by the high curve in FIG. 5. As shown, flow increase for the first seventy percent (0.025 inches) of stroke is from 0 to 2.5 pounds of refrigerant per minute. However, flow for the next thirty percent (0.01 inches) of stroke increases from 2.5to 10.0 pounds of refrigerant per minute. Thus, the structure of the valve provides for a flow increase of some three hundred percent for a forty percent increase in stroke.

When the pulldown period is over and the bulb temperature falls, the pressure on the diaphragm 80 decreases and the piston 40 is urged into the closed position in which the valve pin 70 is once again the only flow control element. The sealing of the sliding piston 40 by the O-ring 43 prevents high pressure liquid refrigerant leaking upwardly into the low side of the system. As shown in FIG. 2, the seal 43 also acts to balance the piston 40 so that the forces created by the pressure drop from the high pressure side of the system (P1) to the low side of the system (P2) does not affect the position of the piston port 30. The pressure (P2) is communicated from the valve chamber 32 to the lower diaphragm chamber 83 by the equalization passage 39. The piston port 30 can be opened only by a force acting from the diaphragm 82 through the buffer plate 86. Contact between the buffer plate 86 and the piston 40 is maintained by the piston spring 52.

It will be understood that when the temperature of the bulb 84 falls sufficiently low the valve pin 70 closes and there is no refrigerant flow through the valve port 62 or the piston port 30 and the expansion valve is effectively shut off.

Although the improved expansion valve has been described by making particular reference to a preferred construction, the details of description are not to be understood as restrictive, numerous variants being possible within the principles disclosed and with the fair scope of the claims hereunto appended.

We claim as our invention:

1. An expansion valve for a refrigeration system including a compressor, an evaporator and a condenser, the expansion valve comprising:

(a) a valve body including an inlet passage, an outlet passage, a piston passage including a piston chamber, and a valve chamber, the piston chamber communicating with the inlet passage and having a piston port communicating with the valve chamber and the valve chamber communicating with the outlet passage, (b) piston means movably mounted in the piston chamber and selectively controlling flow through the piston port, the piston means having an interior passage communicating with the inlet passage and having a pin port communicating with the valve chamber, the piston means having means biasing the piston means into a closed position, (c) a valve pin means movably mounted in the valve chamber and controlling flow through the pin port, the valve pin means having means biasing the pin means into the closed position, (d) temperature responsive means at one end of the valve body, (e) means connecting the temperature responsive means to the valve pin means tending to move the pin means into an open position during normal load conditions, and (f) means connecting the temperature responsive means to the piston means tending to move the piston means into the open position during overload conditions.

2. An expansion valve as defined in claim 1, in which: the valve body includes an abutment and the piston means includes a first end spaced from the abutment and a second end engageable with the piston port, and (h) the piston biasing means includes spring means between the abutment and the first end of the piston means tending to urge the second end of the piston means into the closed position.

3. An expansion valve as defined in claim 1, in which:

(g) the valve body includes an axial passage having an upper end and a lower end, and (h) the piston means includes an upper end received in sliding relation in the upper end of the axial passage and a lower end diametrically spaced from the lower end of the axial passage to define the piston chamber.

4. An expansion valve as defined in claim 3, in which:

(i) an annular seal is provided between the upper end of the piston means and the upper end of the axial passage.

5. An expansion valve as defined in claim 1, in which:

(g) the temperature responsive means includes diaphragm means, and (h) the means connecting the temperature responsive means to the pin means includes pushrod means extending between the diaphragm means and the pin means.

6. An expansion valve as defined in claim 1, in which:

(g) the temperature responsive means includes diaphragm means, and the piston means includes an upper end, and (h) the means connecting the temperature responsive means to the piston means includes a buffer plate selectively engageable with the upper end of the piston means.

7. An expansion valve as defined in claim 5, in which:

(i) the valve body includes stop means, and (j) the diaphragm means includes a buffer plate engageable with the stop means to limit movement of the piston means.

* * * * *